US006878648B2

(12) United States Patent
Mayhorn et al.

(10) Patent No.: US 6,878,648 B2
(45) Date of Patent: Apr. 12, 2005

(54) REGIONALLY IMPRINTED NONWOVEN FABRIC

(75) Inventors: Jennifer Mayhorn, Huntersville, NC (US); Nick Mark Carter, Mooresville, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 10/717,792

(22) Filed: Nov. 20, 2003

(65) Prior Publication Data

US 2004/0152380 A1 Aug. 5, 2004

Related U.S. Application Data

(60) Provisional application No. 60/428,294, filed on Nov. 22, 2002.

(51) Int. Cl.[7] ..... B32B 27/12

(52) U.S. Cl. ..... 442/64; 442/65; 442/66; 442/67; 442/327; 442/408; 428/141; 428/174

(58) Field of Search ..... 442/64–67, 327, 442/408; 428/141, 174

(56) References Cited

U.S. PATENT DOCUMENTS

| | | | | |
|---|---|---|---|---|
| 3,276,944 | A | | 10/1966 | Levy |
| 3,338,992 | A | | 8/1967 | Kinney |
| 3,341,394 | A | | 9/1967 | Kinney |
| 3,485,706 | A | | 12/1969 | Evans |
| 3,502,538 | A | | 3/1970 | Petersen |
| 3,502,763 | A | | 3/1970 | Hartmann |
| 3,509,009 | A | | 4/1970 | Hartmann |
| 3,542,615 | A | | 11/1970 | Dobo et al. |
| 4,190,695 | A | | 2/1980 | Niederhauser |
| 4,329,309 | A | | 5/1982 | Kelly |
| 4,381,326 | A | | 4/1983 | Kelly |
| 4,428,999 | A | * | 1/1984 | George et al. ..... 442/67 |
| 4,636,419 | A | | 1/1987 | Madsen et al. |
| 4,693,920 | A | * | 9/1987 | Agarwal et al. ..... 428/40.4 |
| 5,098,764 | A | | 3/1992 | Bassett et al. |
| 5,144,729 | A | | 9/1992 | Austin et al. |
| 5,187,005 | A | | 2/1993 | Stahle et al. |
| 5,475,903 | A | | 12/1995 | Collins |
| 5,678,379 | A | | 10/1997 | Quattrociocchi |
| 5,906,786 | A | * | 5/1999 | James et al. ..... 264/400 |
| 5,916,659 | A | * | 6/1999 | Koerber et al. ..... 428/86 |
| 6,114,017 | A | | 9/2000 | Fabbricante et al. |
| 6,191,211 | B1 | | 2/2001 | Mussell et al. |
| 6,264,864 | B1 | | 7/2001 | Mackay |

FOREIGN PATENT DOCUMENTS

| | | |
|---|---|---|
| CA | 803714 | 1/1969 |

* cited by examiner

*Primary Examiner*—Ula Ruddock
(74) *Attorney, Agent, or Firm*—Wood, Phillips, Katz, Clark & Mortimer

(57) ABSTRACT

The present invention is directed to a nonwoven fabric, and more specifically to a nonwoven fabric comprised of at least one foreground region and at least one background region, wherein the foreground region of the fabric is an extension of the background region of the fabric in the z-direction and imparted with an enhanced physical and/or aesthetic performance which is dissimilar to a performance that may be imparted within the background region. The foreground region is further characterized in that such region may extend away from the background region so that a continuous or discontinuous path is described. Further still, the foreground and background regions may be of similar or dissimilar basis weights.

2 Claims, 1 Drawing Sheet

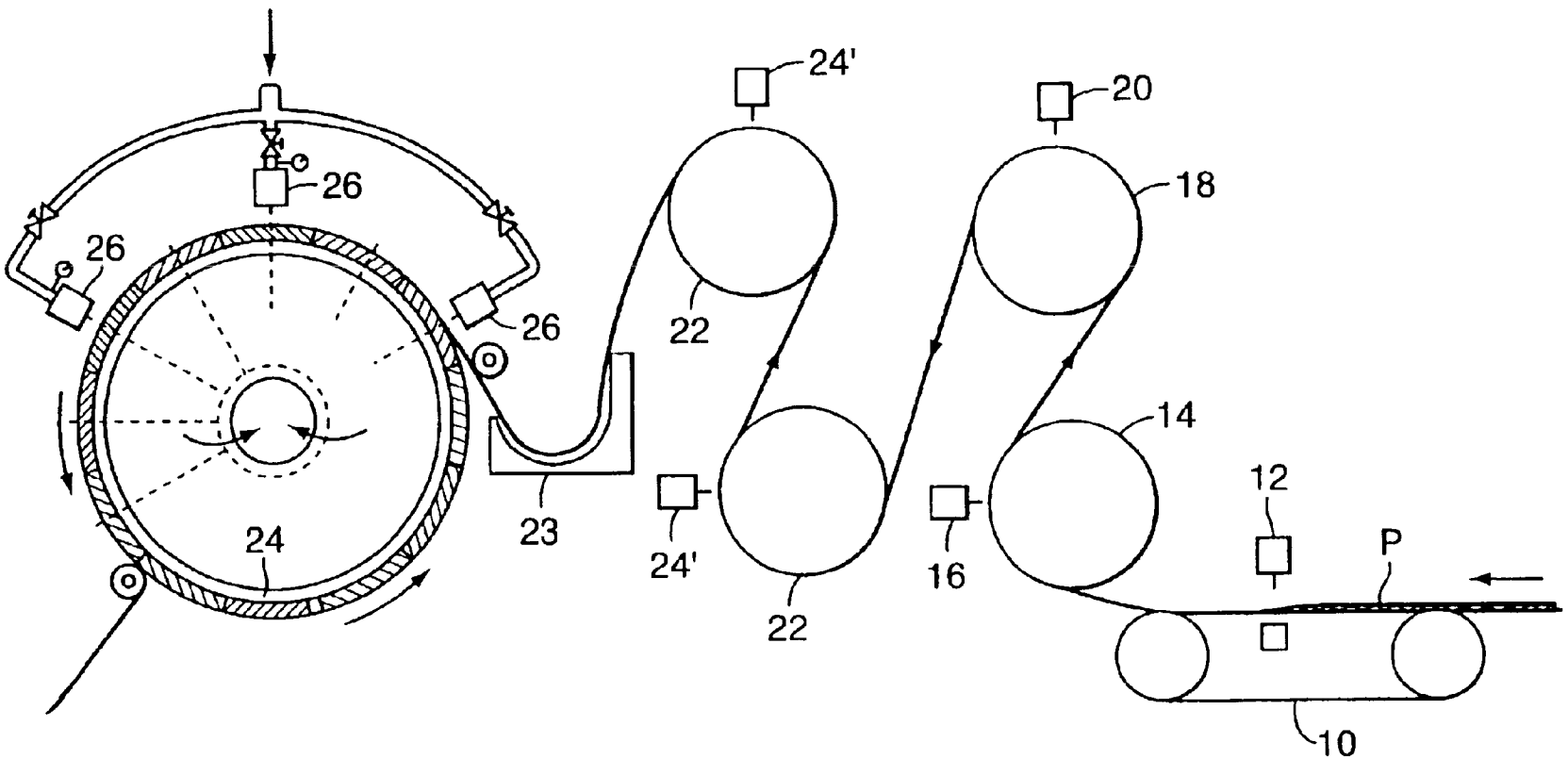
10
P
12
14
16
18
20
22
22
24'
24'
23
24
26
26
26

REGIONALLY IMPRINTED NONWOVEN FABRIC

TECHNICAL FIELD

The present invention generally relates to a nonwoven fabric, and more specifically to a nonwoven fabric comprised of at least one foreground region and at least one background region, wherein the foreground region is an extension of the background region in the z-direction and imparted with an enhanced physical and/or aesthetic performance which is dissimilar to a performance that may be imparted within the background region. The foreground region is further characterized in that such region may extend away from the background region so that a continuous or discontinuous path is described.

BACKGROUND OF THE INVENTION

The production of conventional textile fabrics is known to be a complex, multi-step process. The production of fabrics from staple fibers begins with the carding process whereby the fibers are opened and aligned into a feedstock referred to in the art as a sliver. Several strands of sliver are then drawn multiple times on a drawing frames to; further align the fibers, blend, improve uniformity and reduce the slivers diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high-speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes, as the fabrics are produced directly from the carding process.

Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared to conventional textiles, particularly in terms of resistance to elongation, in applications where both transverse and co-linear stresses are encountered. Hydroentangled fabrics have been developed with improved properties, by the formation of complex composite structures in order to provide a necessary level of fabric integrity. Subsequent to entanglement, fabric durability has been further enhanced by the application of binder compositions and/or by thermal stabilization of the entangled fibrous matrix.

Nonwoven composite structures typically improve physical properties, such as elongation, by way of incorporation of a support layer or scrim. The support layer material can comprise an array of polymers, such as polyolefins, polyesters, polyurethanes, polyamides, and combinations thereof, and take the form of a film, fibrous sheeting, or grid-like meshes. Metal screens, fiberglass, and vegetable fibers are also utilized as support layers. The support layer is commonly incorporated either by mechanical or chemical means to provide reinforcement to the composite fabric. Reinforcement layers, also referred to as a "scrim" material, are described in detail in U.S. Pat. No. 4,636,419, which is hereby incorporated by reference. The use of scrim material, more particularly, a spunbond scrim material is known to those skilled in the art.

Spunbond material comprises continuous filaments typically formed by extrusion of thermoplastic resins through a spinneret assembly, creating a plurality of continuous thermoplastic filaments. The filaments are then quenched and drawn, and collected to form a nonwoven web. Spunbond materials have relatively high resistance to elongation and perform well as a reinforcing layer or scrim. U.S. Pat. No. 3,485,706 to Evans, et al., which is hereby incorporated by reference, discloses a continuous filament web with an initial random staple fiber batt mechanically attached via hydroentanglement, then a second random staple fiber batt is attached to the continuous filament web, again, by hydroentanglement. A continuous filament web is also utilized in U.S. Pat. Nos. 5,144,729; 5,187,005; and 4,190,695. These patents include a continuous filament web for reinforcement purposes or to reduce elongation properties of the composite.

More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, which is hereby incorporated by reference; with the use of such image transfer devices being desirable for providing a fabric with enhanced physical properties as well as an aesthetically pleasing appearance.

For specific applications, a three-dimensionally imaged nonwoven fabric may exhibit a combination of specific performance attributes that are regionally imprinted depending on the end-use application. For example, a hard surface wipe may comprise a tackifier so as to enhance the ability of the wipe to pick up particulates, as well as a disinfectant to remove any contaminates from a given surface. Further, three-dimensionally imaged nonwoven fabrics may be used in home, medical, and hygiene applications wherein it is advantageous to have multiple performance enhancement additives within a wipe.

SUMMARY OF THE INVENTION

The present invention is directed to a nonwoven fabric, and more specifically to a nonwoven fabric comprised of at least one foreground region and at least one background region, wherein the foreground region of the fabric is an extension of the background region of the fabric in the z-direction and imparted with an enhanced physical and/or aesthetic performance which is dissimilar to a performance that may be imparted within the background region. The foreground region is further characterized in that such region may extend away from the background region so that a continuous or discontinuous path is described. Further still, the foreground and background regions may be of similar or dissimilar basis weights.

The nonwoven fabric of the present invention may be either a single or multi-layer fabric comprised of at least one foreground region and at least one background region. The nonwoven fabric is comprised of one or more raised portions that extend out from the plane of the fabric so as to create a foreground region and a background region within the fabric. In a first embodiment, the raised portions or foreground region of the fabric may have a different basis weight than that of the background region of the fabric. Further, the foreground of the fabric is imprinted with a performance enhancing additive, while the background of the fabric comprises a dissimilar performance enhancing additive or completely lacking an additive.

Optionally, the foreground region of the fabric may be comprised of more than one performance enhancing additives. For example, half of the raised portion extending from the plane of the fabric may be imprinted with a hydrophilic additive, while the other half of the raised portions may be coated with a hydrophobic additive. Depending on the end-use application, additives may include, but are not limited to wetting agents, cleaning agents, emollients, astringents, disinfectants, and latherants.

In a second embodiment, the nonwoven fabric is comprised of one or more raised portions, wherein the fabric is the same basis weight throughout. The raised portions of the fabric may be formed on a variety of foraminous surfaces, such as on a belt, a wire or mesh screen, or a three-dimensional image transfer device during the hydroentanglement process. The regionally imprinted nonwoven fabric of the present invention is suitable for a variety of hygiene, medical, and industrial applications.

DETAILED DESCRIPTION

While the present invention is susceptible of embodiment in various forms, hereinafter are described presently preferred embodiments of the invention, with the understanding that the present disclosure is to be considered as exemplifications of the invention, and is not intended to limit the invention to the specific embodiments illustrated.

With reference to FIG. 1, therein is illustrated an apparatus for practicing the present method for forming a nonwoven fabric. The fabric is formed from a fibrous matrix, which typically comprises staple length fibers, but may comprise substantially continuous filaments. The fibrous matrix is preferably carded and cross-lapped to form a fibrous batt, designated F. In a current embodiment, the fibrous batt comprises 100% cross-lap fibers, that is, all of the fibers of the web have been formed by cross-lapping a carded web so that the fibers are oriented at an angle relative to the machine direction of the resultant web. U.S. Pat. No. 5,475,903, hereby incorporated by reference, illustrates a web drafting apparatus.

FIG. 1 illustrates a hydroentangling apparatus for forming the compound imaged nonwoven fabrics in accordance with the present invention. The apparatus includes a first foraminous-forming surface in the form of belt 10 upon which the precursor web P is positioned for pre-entangling by entangling manifold 12 so as to impart the initial three-dimensional image. Pre-entangling of the precursor web, which hereby imparts a first image, is subsequently effected by movement of the web P sequentially over a second image transfer device, such as drum 14 having a foraminous-forming surface, with entangling manifold 16 effecting entanglement and imparting a second three-dimensional image into the web. Further entanglement of the web is effected on the foraminous forming surface of a drum 18 by entanglement manifold 20, with the web subsequently passed over successive foraminous drums 20, for successive entangling treatment by entangling manifolds 24, 24'.

The entangling apparatus of FIG. 1 further includes a three-dimensional imaging drum 24 comprising a three-dimensional image transfer device for effecting imaging of the now-entangled precursor web which is comprised of at least one three-dimensional image. The image transfer device includes a moveable imaging surface which moves relative to a plurality of entangling manifolds 26 which act in cooperation with three-dimensional elements defined by the imaging surface of the image transfer device to affect additional imaging and patterning of the fabric being formed.

Optionally, a support layer or scrim may be placed in face to face juxtaposition with the fibrous web and hydroentangled on a foraminous surface to form a precursor web P with a first three-dimensional image imparted therein. The fibrous web is hydroentangled on a first foraminous surface to form precursor web P and impart a first three-dimensional image. The present invention contemplates that the optional support layer or scrim be any such suitable material, including, but not limited to, wovens, knits, open mesh scrims, and/or nonwoven fabrics, which exhibit low elongation performance. Two particular nonwoven fabrics of particular benefit are spunbond fabrics, as represented by U.S. Pat. Nos. 3,338,992; 3,341,394; 3,276,944; 3,502,538; 3,502,763; 3,509,009; 3,542,615; and Canadian Patent No. 803,714, these patents are incorporated by reference, and nanofiber fabrics as represented by U.S. Pat. Nos. 5,678,379 and 6,114,017, both incorporated herein by reference.

Manufacture of the regionally imprinted nonwoven fabrics embodying the principles of the present invention is initiated by providing the fibrous matrix, which can include the use of staple length fibers, continuous filaments, and the blends of fibers and/or filaments having the same or different composition. Fibers and/or filaments are selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for blending with dispersant thermoplastic resins include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 10 inches, the range of 1 to 3 inches being preferred and the fiber denier selected in the range of 1 to 22, the range of 2.0 to 8 denier being preferred for general applications. The profile of the fiber and/or filament is not a limitation to the applicability of the present invention.

In a first embodiment, the raised portions or foreground region of the fabric may have a different basis weight than that of the background region of the fabric. Further, the foreground of the fabric is imprinted with a performance and/or aesthetic enhancing additive, while the background of the fabric may be comprised of a different performance and/or aesthetic enhancing additive or completely lacking an additive. In accordance with the present invention, the performance enhancing additives may be imparted utilizing various techniques known in the art, including, but not limited to impregnating, padding, spray coating, or kiss coating.

In a second embodiment, the nonwoven fabric is comprised of one or more raised portions, wherein the fabric is the same basis weight throughout. The raised portions of the fabric may be formed on a variety of foraminous surfaces, such as on a belt, a wire or mesh screen, or a three-dimensional image transfer device during the hydroentanglement process. Further, the raised portions of the foreground region are further characterized in that such a region may extend away from the background region so that a continuous path is described, such that fibers of the foreground region and the fibers of the background region are interconnected by fibers orientated in the z-direction or in a discontinuous path, such that the foreground region is connected to the background region by means of fibrous transition areas.

It is also within the purview of the present invention that the nonwoven fabrics comprise additional nonwoven or woven fabric layers or film layers so as to form a laminate construct. Various film layers may include, cast films, extruded films, and reticulated films. Extruded films can be formed in accordance with the following representative direct extrusion film process. Blending and dosing storage comprising at least two hopper loaders, feed into two variable speed augers. The variable speed augers transfer predetermined amounts of polymer chip into a mixing hopper. The mixing hopper contains a mixing propeller to further the homogeneity of the polymer or a polymer mixture. The polymer chip feeds into a multi-zone extruder. Upon mixing and extrusion from multi-zone extruder, the polymer compound is conveyed via heated polymer piping through screen changer, wherein breaker plates having different screen meshes are employed to retain solid or semi-molten polymer chips and other macroscopic debris. The polymer is then fed into a melt pump, and then to a combining block. The combining block allows for multiple film layers to be extruded, the film layers being of either the same composition or fed from different systems as described above. The combining block is connected to an extrusion die, which is positioned in an overhead orientation such that molten film extrusion is deposited at a nip between a nip roll and a cast roll.

When the nonwoven fabric of the present invention is to receive a film layer extrusion, a substrate material source is provided in roll form to a tension-controlled unwinder. The base layer is unwound and moves over the nip roll. The molten film extrusion from the extrusion die is deposited onto the substrate material at the nip point between the nip roll and the cast roll. The newly formed base layer and film composite is then removed from the cast roll by a stripper roll and wound onto a new roll.

Breathable films, such as monolithic and microporous films, or reticulated films, can also be used within the laminate filtration structure. Monolithic films, as taught in U.S. Pat. No. 6,191,211, and microporous films, as taught in U.S. Pat. No. 6,264,864, both patents herein incorporated by reference, represent the mechanisms of forming such breathable barrier films. Reticulated films, such as those of U.S. Pat. Nos. 4,381,326 and 4,329,309, are representative of macroporous films.

Optionally, continuous filament fabrics, including micro-denier and nano-denier fabrics, may be incorporated into a laminate structure. In general, continuous filament nonwoven fabric formation involves the practice of the spunbond process. A spunbond process involves supplying a molten polymer, which is then extruded under pressure through a large number of orifices in a plate known as a spinneret or die. The resulting continuous filaments are quenched and drawn by any of a number of methods, such as slot draw systems, attenuator guns, or Godet rolls. The continuous filaments are collected as a loose web upon a moving foraminous surface, such as a wire mesh conveyor belt. When more than one spinneret is used in line for the purpose of forming a multi-layered fabric, the subsequent webs are collected upon the uppermost surface of the previously formed web. The web is then at least temporarily consolidated, usually by means involving heat and pressure, such as by thermal point bonding. Using this means, the web or layers of webs are passed between two hot metal rolls, one of which has an embossed pattern to impart and achieve the desired degree of point bonding, usually on the order of 10 to 40 percent of the overall surface area being so bonded.

Suitable nano-denier continuous filament layers can be formed by either direct spinning of nano-denier filaments or by formation of a multi-component filament that is divided into nano-denier filaments prior to deposition on a substrate layer. U.S. Pat. Nos. 5,678,379 and 6,114,017, both incorporated herein by reference, exemplify direct spinning processes practicable in support of the present invention. U.S. Pat. Nos. 5,678,379 and 6,114,017, both incorporated herein by reference, exemplify direct spinning processes practicable in support of the present invention.

The fabric of the present invention may be utilized in a variety of hygienic, medical, and industrial applications. Suitable hygiene applications include, but are not limited to disposable baby changing pads, wherein the foreground of the fabric can be treated with various different surfactants so as to control the absorption of liquid insults. Further, the fabric is suitable for use as a hygienic wipe, such as a facial or other cleansing wipe.

From the foregoing, numerous modifications and variations can be effected without departing from the true spirit and scope of the novel concept of the present invention. It is to be understood that no limitation with respect to the specific embodiments disclosed herein is intended or should be inferred. The disclosure is intended to cover, by the appended claims, all such modifications as fall within the scope of the claims.

What is claimed is:

1. A nonwoven fabric having an expansive surface comprising at least one foreground region comprised of one or more raised portions and a background region from which said foreground region extends in a Z-direction of said fabric, wherein said foreground region comprises one or more performance or aesthetic enhancing additives applied only to said foreground region of said expansive surface, and said background region of said expansive surface comprises one or more performance or aesthetic enhancing additives and said foreground and background performance or aesthetic additives are dissimilar from one another.

2. A wipe having an expensive surface comprising at least one foreground region comprised of one or more raised portions and a background region from which said foreground region extends in a Z-direction of said fabric, wherein said foreground region comprises one or more performance or aesthetic enhancing additives applied only to said foreground region of said expansive surface, and said background region comprises one or more performance or aesthetic enhancing additives and said foreground and background performance or aesthetic additives are dissimilar from one another.

* * * * *